US005889240A

United States Patent [19]

Purosto et al.

[11] Patent Number: 5,889,240

[45] Date of Patent: Mar. 30, 1999

[54] ARRANGEMENT IN AN ELEVATOR PUSH BUTTON

[75] Inventors: Tero Purosto, Hyvinkää, Finland; Antti Laine, Hong Kong, Hong Kong; Asko Juntunen, Oulu, Finland

[73] Assignee: Kone Oy, Helsinki, Finland

[21] Appl. No.: 845,199

[22] Filed: Apr. 21, 1997

[30] Foreign Application Priority Data

Apr. 23, 1996 [FI] Finland ..... 961748

[51] Int. Cl.[6] ..... B66B 3/00

[52] U.S. Cl. ..... 187/395; 187/414

[58] Field of Search ..... 187/395, 414

[56] References Cited

U.S. PATENT DOCUMENTS

| | | | |
|---|---|---|---|
| 2,525,769 | 10/1950 | Bruns | 327/528 |
| 4,197,586 | 4/1980 | Nidiffer . | |
| 4,283,758 | 8/1981 | Irving | 362/251 |
| 5,039,832 | 8/1991 | Polacek et al. | 200/317 |
| 5,162,665 | 11/1992 | Troyen | 307/112 |
| 5,256,843 | 10/1993 | Chiba et al. . | |
| 5,477,942 | 12/1995 | Shea et al. | 187/395 |
| 5,490,581 | 2/1996 | Warner et al. | 187/414 |
| 5,507,366 | 4/1996 | Huang | 187/395 |
| 5,587,567 | 12/1996 | Winter et al. | 187/395 |

FOREIGN PATENT DOCUMENTS

| | | |
|---|---|---|
| 0636569A2 | 2/1995 | European Pat. Off. . |
| 0638508A1 | 2/1995 | Germany . |
| 4436050A1 | 4/1996 | Germany . |
| 2018516 | 10/1979 | United Kingdom . |

*Primary Examiner*—Kenneth Noland
*Assistant Examiner*—Khoi H. Tran

[57] ABSTRACT

Push button arrangement for an elevator including a push button (7) with a mounting element (1), a mounting base (10), a cover plate (17) and a circuit card (3). The push button (7) is attached to the mounting element (1) using double-sided tape. The push button (7) is provided with an opening (8) for a call acknowledgement light. The mounting element (1) is fitted by its legs (2) in holes (19) provided in the circuit card (3). The circuit card (3) is provided with membrane switches (4) and attached to the mounting base (10) by gluing so that its lugs engage holes (11) in the mounting base (10). The cover plate (17) covers the push button panel.

20 Claims, 4 Drawing Sheets

ARRANGEMENT IN AN ELEVATOR PUSH BUTTON

BACKGROUND OF THE INVENTION

1. Field of the Invention

The present invention relates to a push button arrangement for an elevator.

2. Description of Related Art

As is known, an elevator has push buttons that are used to call the elevator to a given floor. There are two push buttons, one for the up direction and the other for the down direction. Push buttons have conventionally been implemented using a mounting element of a high-relief structure. The push button itself is mounted on this mounting element. The push buttons may use metal film switches or other switches which are relatively thick in structure. Such a push button arrangement must be installed by the flush-mounting principle and it is also expensive and requires a large number of different parts which render the construction quite complex. Neither do architects like push buttons having a thick high-relief structure.

SUMMARY OF THE INVENTION

To provide a solution to the drawbacks described above, a new arrangement in an elevator push button is presented as an invention.

In the solution of the invention, the push button is provided with a thinner mounting element and uses membrane switches, which also have a thin structure. To mount the push button, the push button is first attached by means of double-sided tape to the mounting element, which in turn is attached to a circuit board, which is further attached by means of double-sided tape to a mounting base consisting of a profiled aluminium part. The push button arrangement is covered with a cover plate provided with holes corresponding to the push buttons. The cover plate is attached by means of lugs. The result is a simple low-relief pushbutton arrangement.

The advantages achieved through the invention include:

- the push button arrangement is advantageous in respect of price
- a structure with a very low relief is achieved
- reliable switching elements consisting of metal or polyethylene membranes or thin membrane switches can be used
- few components, easy to install
- architect-friendly

BRIEF DESCRIPTION OF THE DRAWINGS

In the following, the invention is described in detail by the aid of application examples by referring to the attached drawings, in which.

DETAILED DESCRIPTION OF THE INVENTION

Figure 1A:
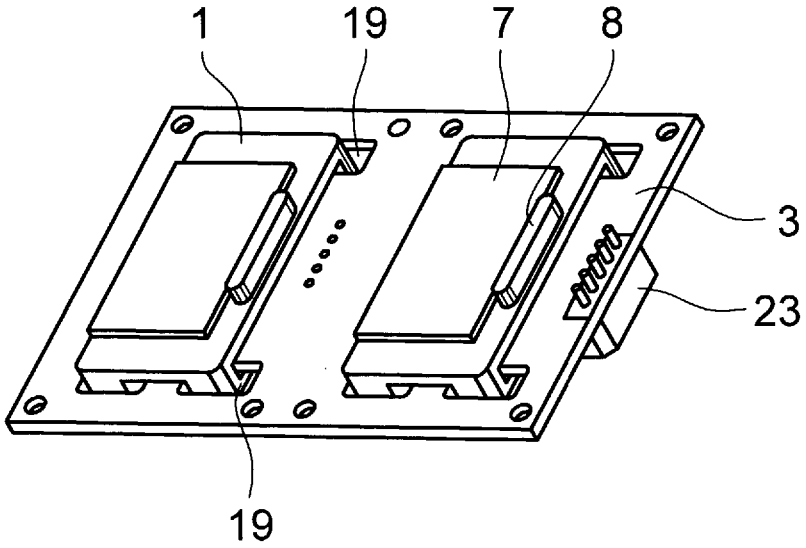
FIGS. 1*a* and 1*b* illustrate the structure of the mounting element and the push button attached to it, seen from above and from below and fitted on a circuit card.
Figure 1B:
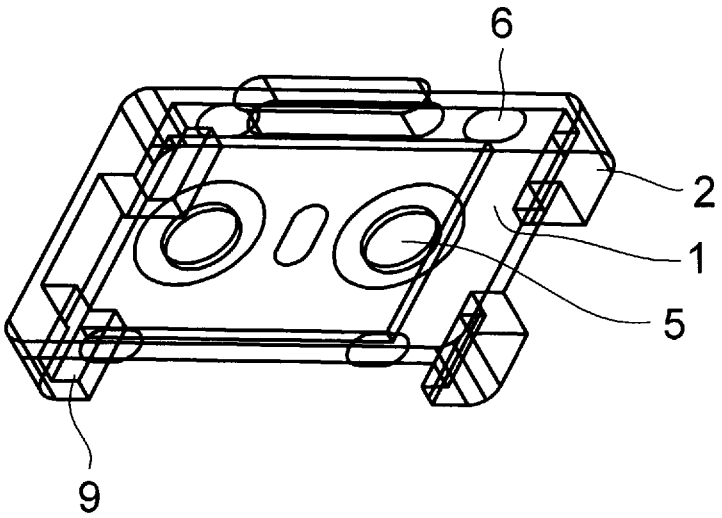

FIGS. 1*a* and 1*b* show a mounting element 1 and a push button 7 fitted on a circuit card 3. The mounting element 1 is generally a rectangular part, but it may also be of a square design or some other shape, e.g. circular. It is generally made of plastic, but it can also be made of metal or some other suitable material. The mounting element 1 is provided with four legs 2 on its underside, and these act as hinges. The body of the circuit board encircles the legs. When a pressure is applied to the push button 7, the "loose" mounting of the legs 2 allows the mounting element 1 to adapt to this. The mounting element 1 may also have only three legs. The legs 2 of the mounting element 1 are generally placed at the corners, on the underside of the mounting element 1. They are made of the same material as the mounting element itself. The legs 2 are aligned in the same direction with the short edges of the mounting element and they have foot parts 9 bent at an angle of 90 degrees towards the central portion of the mounting element. The length of the legs 2 is dependent on the thickness of the body of the circuit card 3 and on the thickness of the pads 5 and the membrane switches. These three factors together determine the length of the legs 2. The leg length must equal at least the total thickness of these three parts plus the height of the foot 9. The legs 2 must also have a sufficient tolerance to allow the mounting element 1 to be easily fitted in position. Under the mounting element 1 there are two circular pads 5, preferably placed on the underside of the mounting element 1. The pads 5 are attached to their base by means of double-sided tape. The underside of the mounting element 1 is also provided with five oval stop blocks 6 to prevent excessive swinging of the mounting element. They are preferably disposed on the underside of the mounting element 1 so that there is one stop block beside each leg at the longer edges of the mounting element 1 while one stop block is preferably located between the two pads 5. The stop blocks 6 must not be too high or otherwise the mounting element will be too rigid in operation. The operation of the mounting element 1 is substantially dependent on the body of the circuit card 3, on the two membrane switches 4 on the circuit card 3 and on the two pads 5 of the mounting element 1, which are placed opposite to the membrane switches. The height and size of the stop blocks 6 must preferably be so selected that the mounting element 1 will also be functional in production series regardless of tolerance variations. The circuit card 3 is preferably provided with holes 19 such that the mounting element 1 can be easily fitted on it by its legs 2. The mounting element 1 is installed by lightly pressing it so that the legs 2 of the mounting element 1 go into the holes 19 preferably provided for them in the circuit card 3. The circuit card 3 is attached by means of double-sided tape to the profiled aluminium element acting as a mounting base 10.

Mounted in the mounting element 1 is a push button 7, which is of a square or other design such as e.g. a round shape and made of metal. It may also be made of plastic or some other material. The push button 7 has an elongated hole 8 accommodating a protrusion in the mounting element 1 so that the light emitted by LEDs 22 is visible through the hole. The mounting element 1 also acts as a light diffuser. The light of the LEDs on the circuit card 3 functions as an acknowledgement light indicating that the call has been registered. The mounting element 1 diffuses this light so that it will illumine the whole area of the acknowledgement light. The number of LEDs 22 on the circuit card 3 must be sufficient with respect to the surface area to produce a smooth light visible through the hole 8 in the push button 7. The push button edge on the side of the hole 8 extends somewhat over the mounting element 1, thus acting as a shield. The push button 7 is also attached to the mounting element 1 by means of double-sided tape or glue. For this purpose, impact damping tape is often used. The use of tape results in a low-relief assembly and allows different materials to be attached to each other. It is also possible to use other known fastening methods. The elongated opening 8 for the acknowledgement light is located at one edge of the push button 7, but it can also be placed elsewhere in the push button 7 and it may be of a different design, e.g. a square or circular opening. Push buttons 7 of different designs can be produced as ordered by the customer. For reliable operation, at least two membrane switches 4 are needed in the widthways direction, although the push button 7 also works with only one membrane switch 4. The push button 7 works best in the widthways direction if it is provided with two membrane switches, in which case the switching distance for the push button 7 is about 0.8 mm. The pads 5 of the mounting plate 1 are located opposite to the membrane switches 4, producing a contact.

Figure 2A:
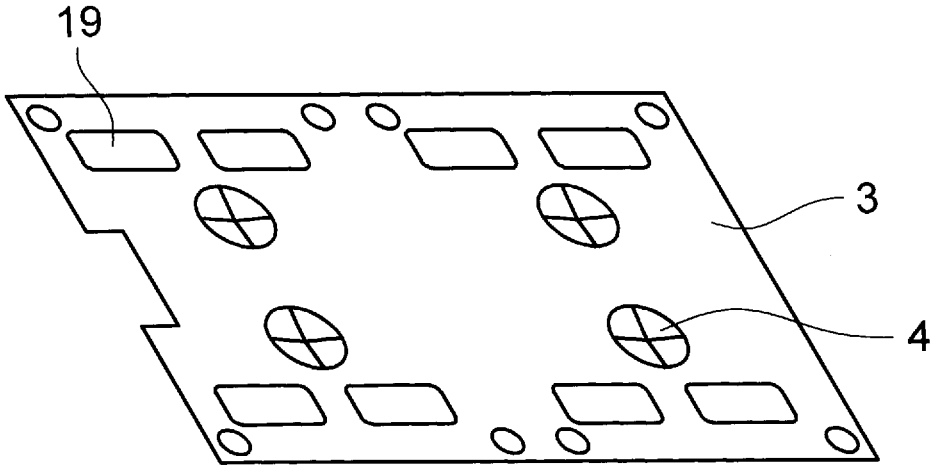
FIGS. 2*a* and 2*b* present the circuit card as seen from above and from below.
Figure 2B:
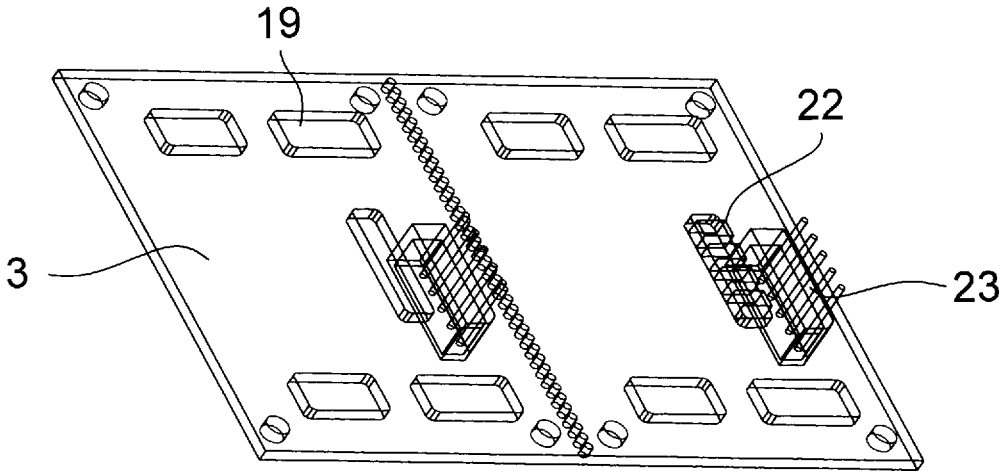

FIGS. 2*a* and 2*b* present a circuit card 3 as seen from above and from below. It is provided with holes 19 for the legs 2 of the mounting element 1, laid out at suitable locations. The circuit card 3 also has two membrane switches 4, which are preferably placed side by side. Other types of low-relief switches can also be used. In addition, the card is provided with four LEDs to ensure that the acknowledgement light is clearly visible. The circuit card 3 also has other components, which have been selected on the basis of their advantageous low-relief structure, as well as mounting holes. On the underside of the circuit card 3 there is a plug 23 for the connection of electricity.

Figure 3:
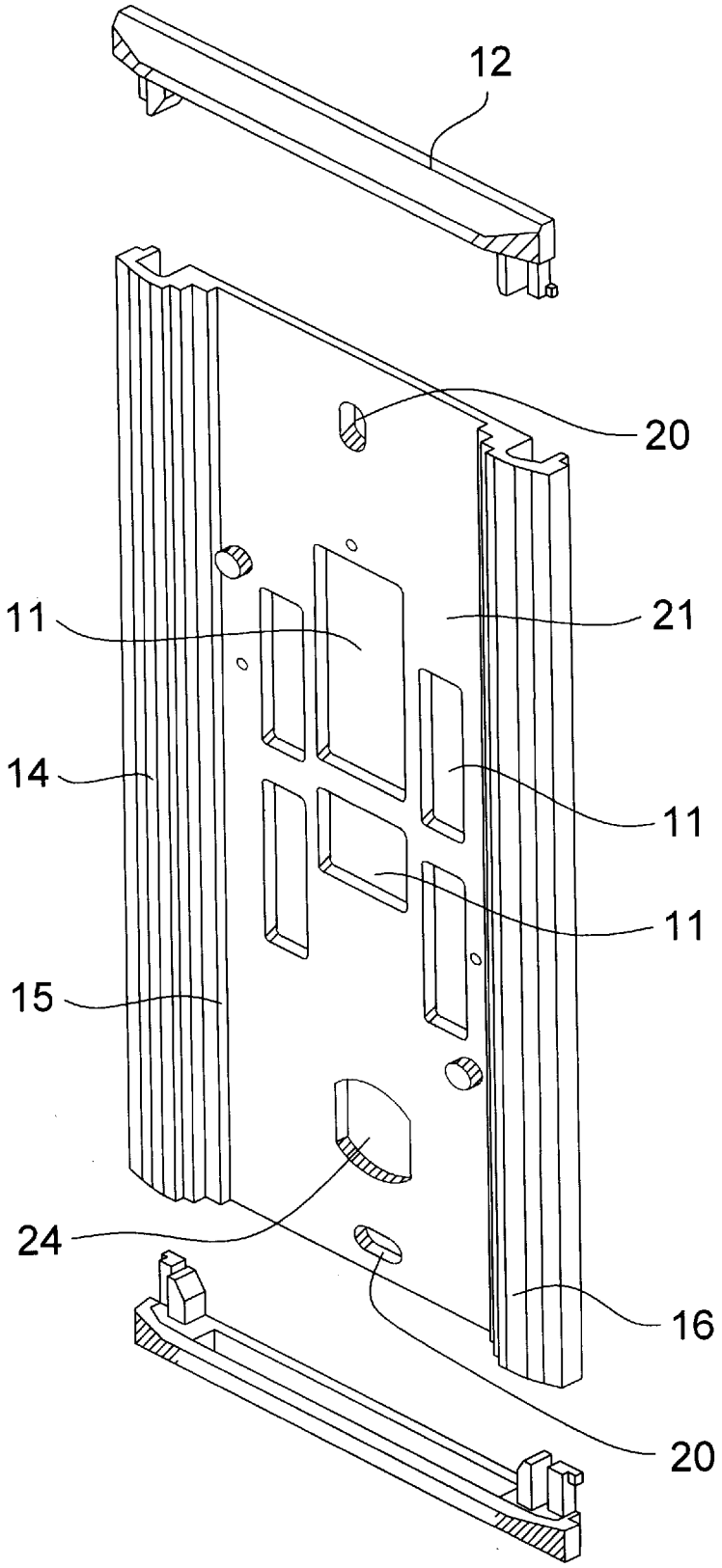
FIG. 3 presents a mounting base implemented as a profiled aluminium element.

FIG. 3 presents a mounting base 10 made of profiled aluminium, to which the mounting element 1 together with the circuit card 3 is attached using double-sided tape or glue. The mounting base 10 is provided with holes 11 at suitable locations to accommodate the components and other protruding parts of the circuit card 3. The mounting base 10 is also provided with end elements 12 made of plastic and attached to the mounting base 10 by means of claws or by some other known fastening method. The end elements 12 may also be made of a different material, such as metal. The mounting base 10 has mounting holes 20 and a hole 24 for electric conductors. The edges 14 of the mounting base 10 are bent outwards so as to form grooves on the underside of the mounting base 10. On the outer edge of the grooves there is also a small protrusion (not visible in the figure). At both edges 14 on the inside of the mounting base 10 there are two shoulders 15 and 16 at different heights. The lower shoulders 15 form a narrower area in the bottom portion 21 of the mounting base 10 while the upper shoulders 16 are for the cover plate 17. The mounting base 10 is mounted beside the elevator door on a landing. It can be secured by means of screws or double-sided tape. Because of its low-relief structure, it need not be mounted flush with the wall surface.

Figure 4:
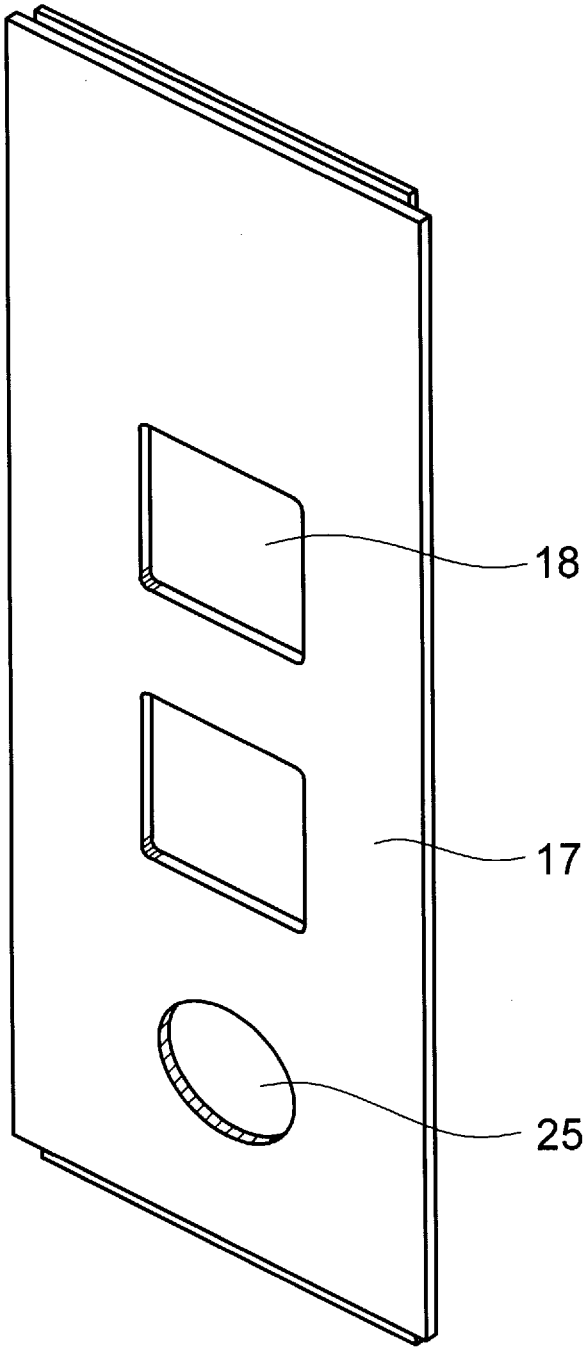
FIG. 4 presents a cover plate.

FIG. 4 shows a cover plate 17 of a rectangular shape and provided with at least one rectangular hole 18. The cover plate may have more than one hole, and their design may vary according to the designs of the push buttons 7. Generally there are two push buttons 7, one for each direction, in which case two holes 18 are needed. The location of the holes 18 in the cover plate 17 corresponds to the location of the push buttons 7. The cover plate 17 also has a hole 25 for a lock. The arrangement does not include a lock in all cases. The cover plate 17 is mounted on the upper shoulders 16 on the mounting base 10. It can be fastened without using tape. The holes 18 have a tolerance of about 0.2 mm between the push button 7 and the cover plate 17. The electric conductors to the push button arrangement are passed through the wall to the plug 23 on the circuit card 3. In this way, a low-relief surface-mounted push button arrangement is achieved.

It is obvious to a person skilled in the art that different embodiments of the invention are not restricted to the examples described above, but that they can be varied within the scope of the claims presented below. A low-relief and thin-structured push button arrangement as described above can also be used in the push button panel in an elevator car, by building a low-relief push button panel of a thin and, if necessary, narrow structure which can be moved to any wall and does not require flush-mounting. The mounting base used in the push button arrangement is a narrow track-like structure which is attached to the push button panel using either double-sided tape or by some other known fastening method. To this track-like structure is then attached, again using double-sided tape, a circuit card 3, of which a band-like structure is formed by joining together a number of circuit cards 3 corresponding to the number of push buttons 7. Instead of a track-like structure, other types of mounting base are also used, e.g. rectangular or circular structures, as required in each case. The mounting elements 1 together with the push buttons 7 are then mounted on the circuit card 3. It is also possible to attach other signalling devices or shields for information to this card. This low-relief push button arrangement of the invention can also be used on escalators. The mounting element 1 can also be made of a coloured material if necessary, provided that it has a sufficient material strength.

What is claimed is:

1. Push button arrangement for an elevator, said arrangement comprising:

at least one push button plate mounted to a mounting element, said mounting element having a plate-like part and legs extending therefrom;

a circuit card mounted to a mounting base, said circuit card provided with holes in which said legs of the mounting element are inserted and at least one switch for establishing an electrical connection by said mounting element to signal the elevator; and a cover plate mounted to said mounting base for enclosing said mounting element and said circuit card therebetween, said cover plate provided with at least one hole aligned with said at least one push button plate.

2. Push button arrangement according to claim 1, wherein the at least one switch is a membrane switch.

3. Push button arrangement according to claim 2, wherein the circuit card is provided with two membrane switches for each push button plate.

4. Push button arrangement according to claim 1, wherein the mounting element is provided with pads to prevent the mounting element from swinging.

5. Push button arrangement in an elevator comprising:

a push button mounted to a mounting element, a mounting base, a cover plate and a circuit card, the mounting element being a plate-like part having legs and the circuit card provided with holes in which the legs of the mounting element are inserted, said circuit card being provided with switches, and the push button being formed from a plate, and the circuit card being mounted to the mounting base and the cover plate so that the push button is aligned with a hole in the cover plate, wherein the switches are membrane switches, the circuit card is provided with two membrane switches for each push button, and the mounting element is provided with pads to prevent the mounting element from swinging.

6. Push button arrangement according to claim 5, wherein the mounting element is provided with stop blocks placed adjacent to the legs and midway between the pads on the underside of the mounting element.

7. Push button arrangement according to claim 6, wherein the length of the legs of the mounting element is at least equal to the total thickness of the circuit card, the membrane switches and the pads.

8. Push button arrangement according to claim 7, wherein the legs of the mounting element act as hinges.

9. Push button arrangement according to claim 8, wherein a foot part of one of the legs is long enough so that the mounting element easily fits in the holes in the circuit card.

10. Push button arrangement according to claim 9, wherein the push button plate, mounting element, circuit card and mounting base are disposed under each other in a staggered manner so that lugs on the circuit card engage holes provided in the mounting base.

11. Push button arrangement according to claim 10, wherein the push button arrangement includes other low-relief structured components.

12. Push button arrangement according to claim 11, wherein the mounting element acts as a light diffuser.

13. Push button arrangement according to claim 12, wherein the push button plate, mounting element, circuit card and mounting base are attached to each other using one of impact-resistant double-sided tape or glue.

14. Push button arrangement for an elevator, said arrangement comprising:

at least one push button plate mounted to a mounting element, said mounting element having a plate-like part and legs extending therefrom and pads positioned on the underside of said plate-like part;

a circuit card mounted to a mounting base and to said legs of the mounting element, said circuit card provided with at least one membrane switch for establishing an electrical connection by said mounting element to signal the elevator; and a cover plate mounted to said mounting base for enclosing said mounting element and said circuit card therebetween, wherein said push button plate, said mounting element, said circuit card and said mounting based are attached to each other using impact-resistant double-sided tape, and the length of each of said legs is at least equal to the total thickness of said circuit card, said at least one membrane switch, and said pads.

15. Push button arrangement according to claim 14, wherein the circuit card is provided with two membrane switches for each push button plate.

16. Push button arrangement according to claim 14, wherein the mounting element is provided with stop blocks, which are preferably placed adjacent to the legs and midway between the pads on the underside of the mounting element.

17. Push button arrangement to claim 14, wherein the legs of the mounting element act as hinges.

18. Push button arrangement according to claim 14, wherein the push button plate, mounting element, circuit card and mounting base are disposed under each other in a staggered manner.

19. Push button arrangement according to claim 14, wherein the push button arrangement includes other low-relief structured components.

20. Push button arrangement according to claim 14, wherein the mounting element acts as a light diffuser.

* * * * *